US005816483A

United States Patent [19]

Gasper

[11] Patent Number: 5,816,483

[45] **Date of Patent: *Oct. 6, 1998**

[54] AUTOMATICALLY-OPERATING BOTTOM STRUCTURE IN A COLLAPSIBLE CONTAINER

[75] Inventor: Thomas M. Gasper, Ft. Wayne, Ind.

[73] Assignee: Creative Tech Marketing, Strongsville, Ohio

[ * ] Notice: The term of this patent shall not extend beyond the expiration date of Pat. No. 5,531,374.

[21] Appl. No.: 855,184

[22] Filed: May 13, 1997

Related U.S. Application Data

[63] Continuation of Ser. No. 748,466, Nov. 8, 1996, Pat. No. 5,715,991, which is a continuation of Ser. No. 621,042, Mar. 22, 1996, Pat. No. 5,613,694, which is a continuation of Ser. No. 420,355, Apr. 11, 1995, Pat. No. 5,531,374, which is a continuation-in-part of Ser. No. 344,989, Nov. 25, 1994, abandoned.

[51] Int. Cl.[6] ..... B65D 5/36

[52] U.S. Cl. ..... 229/109; 229/117; 229/184; 229/185; 493/163

[58] Field of Search ..... 229/108, 108.1, 229/109, 117, 117.01, 184, 185, 117.05, 117.06; 220/418, 462; 493/163, 181; 53/564

[56] References Cited

U.S. PATENT DOCUMENTS

| | | | |
|---|---|---|---|
| 1,720,146 | 7/1929 | Reese | 229/108.1 |
| 2,826,350 | 3/1958 | Marx | 229/117 |
| 2,858,968 | 11/1958 | Lellaton | 229/117 |
| 2,934,254 | 4/1960 | Ullger | 229/108.1 |
| 3,083,889 | 4/1963 | Christensson | 220/462 |
| 3,101,167 | 8/1963 | Styler . | |
| 3,115,291 | 12/1963 | Kotowick | 229/117.01 |
| 3,132,791 | 5/1964 | Haysler et al. . | |
| 3,344,971 | 10/1967 | Walker et al. . | |
| 3,373,917 | 3/1968 | Cox . | |
| 3,525,466 | 8/1970 | Robinson | 229/117 |
| 3,561,667 | 7/1971 | Saltman | 220/418 |
| 3,565,235 | 2/1971 | Brown . | |
| 3,642,192 | 2/1972 | Wilcox Jr., et al. | 229/39 |
| 3,809,310 | 5/1974 | Vanderlugt, Jr. | 229/26 |
| 3,877,631 | 4/1975 | Lai et al. | 229/41 |
| 4,109,985 | 8/1978 | Lieb, Jr. | 312/262 |
| 4,146,169 | 3/1979 | Meyers et al. | 229/117 |
| 4,166,567 | 9/1979 | Beach, Jr. et al. | 229/23 |
| 4,185,764 | 1/1980 | Cote | 229/16 |
| 4,199,098 | 4/1980 | Lopez | 229/41 |
| 4,243,171 | 1/1981 | Prin . | |
| 4,244,510 | 1/1981 | Snyder et al. . | |

(List continued on next page.)

FOREIGN PATENT DOCUMENTS

| | | | |
|---|---|---|---|
| 2574755 | 6/1986 | France . | |
| 2243596 | 11/1991 | United Kingdom | 229/109 |

OTHER PUBLICATIONS

PCT Search Report as complied by European Patent Office (Applicant: Creative Tech Marketing, et al.; International Application No.: PCT/US96/03803; International Filing Date: Mar. 22, 1996), prior art documents as cited therein.

*Primary Examiner*—Gary E. Elkins
*Attorney, Agent, or Firm*—Benesch, Friedlander, Coplan & Aronoff LLP

[57] ABSTRACT

An automatically-operating bottom structure for use in a collapsible container includes a band (80, 84) pivotally connected to a first pair of panels (16, 20), a first pair of bottom flaps (120, 122 and 160, 162) connected to a second pair of panels (18, 22), a second pair of bottom flaps (124, 126) connected to a third pair of panels (17, 19), a third pair of bottom flaps (164, 166) connected to a fourth pair of panels (21, 23) a first pair of web panels (128, 130) and a second pair of web panels (168, 170). The band and bottom flaps are folded within the container when the container is in a folded-flat condition, but automatically form an operative bottom structure when the folded-flat container is moved to a fully-expanded condition.

9 Claims, 4 Drawing Sheets

OTHER PUBLICATIONS

| | | | |
|---|---|---|---|
| 4,260,100 | 4/1981 | Hoffman . | |
| 4,289,267 | 9/1981 | Mayea . | |
| 4,428,499 | 1/1984 | Nauheimer | 229/117.06 |
| 4,448,309 | 5/1984 | Roccaforte et al. | 206/525 |
| 4,453,665 | 6/1984 | Roccaforte et al. . | |
| 4,470,540 | 9/1984 | Koltz . | |
| 4,549,690 | 10/1985 | Rosenburg . | |
| 4,607,785 | 8/1986 | Croley | 229/109 |
| 4,676,429 | 6/1987 | Crowe et al. | 229/109 |
| 4,742,915 | 5/1988 | Ringer | 229/109 |
| 4,747,485 | 5/1988 | Chaussadas | 206/427 |
| 4,760,922 | 8/1988 | Northgrave | 229/117.01 |
| 4,834,285 | 5/1989 | Boots | 229/109 |
| 4,854,474 | 8/1989 | Murray et al. | 220/462 |
| 4,856,705 | 8/1989 | Carr et al. | 229/109 |
| 4,871,068 | 10/1989 | Dreyfus | 206/428 |
| 4,881,683 | 11/1989 | Linnemann | 229/117.01 |
| 4,917,289 | 4/1990 | Linnemann et al. | 229/109 |
| 5,040,721 | 8/1991 | Essack | 229/112 |
| 5,115,965 | 5/1992 | Alepuz | 229/109 |
| 5,295,623 | 3/1994 | Bacques et al. | 229/109 |
| 5,445,315 | 8/1995 | Shelby | 229/117.06 |
| 5,531,374 | 7/1996 | Gasper | 229/109 |
| 5,613,694 | 3/1997 | Gasper | 229/109 |

AUTOMATICALLY-OPERATING BOTTOM STRUCTURE IN A COLLAPSIBLE CONTAINER

CROSS-REFERENCE TO RELATED APPLICATION

This is a continuation of application Ser. No. 08/748,466 filed on Nov. 8, 1996, (now U.S. Pat. No. 5,715,991), application Ser. No. 08/621,042 filed on Mar. 22, 1996 (now U.S. Pat. No. 5,613,694), which is a continuation of application Ser. No. 08/420,355 filed on Apr. 11, 1995 (now U.S. Pat. No. 5,531,374), which is a continuation-in-part of Ser. No. 08/344,989 filed on Nov. 25, 1994 (now abandoned).

This is a continuation-in-part of application Ser. No. 08/344,989 filed Nov. 25, 1994, now abandoned.

BACKGROUND OF THE INVENTION

This invention pertains to the art of collapsible containers and more particularly to automatically-operating bottom structures for use with collapsible containers. The invention is specifically applicable to eight-sided collapsible containers of the type used in the meat packing industry and will be described with particular reference thereto. In an alternative embodiment, the invention combines an automatically-operating bottom structure with a collapsible container having a plastic liner affixed to the interior panel surfaces thereof. As the bottom structure is automatically-operated, the plastic liner is drawn into the container as it opens. It will be appreciated, though, that the invention has broader applications such as for use with multi-sided collapsible containers for products in other industries or for merchandising, store displays or the like.

One prior art automatically-operated bottom structure is disclosed in U.S. Pat. No. 4,856,705 to Carr, et al. That patent describes a box which may be unfolded in a simple manner from a closed to a fully-expanded condition by an operator inserting his hands into the top portion and extending the folded blanks apart to form the fully-expanded condition. As that occurs, a band flap spans a traverse distance between opposing panels. Bottom flap panels are then manually folded downwardly and interdigitally fitted with one another. The band flap prevents the bottom flap panels from pivoting more than 90° relative to their respective vertical side panels.

One problem with the above discussed automatically-operated box and many others like it is that an operator must bend over and insert his hands into the box to push apart the pair of vertical side panels. In addition, once the box is opened, the operator must then reach down into the box to interdigitally connect the bottom flap panels with one another. This procedure is inherently awkward, especially for large boxes, labor intensive, and time consuming.

In certain applications, it is desirable that a box be opened by an operator by merely applying pressure to the outside surfaces of a pair of opposing panels forming the box. One such application is the meat packing industry where reaching into a fresh box to operate it into a fully-expanded condition may cause contamination thereof.

SUMMARY OF THE INVENTION

The present invention contemplates a new and improved automatically-operating bottom structure for use with a collapsible container adapted to be selectively moved between a folded-flat condition and a fully-expanded condition merely through application of opposing forces to outside surfaces of the container panels.

The automatically-operating bottom structure of the invention comprises a band pivotally connected to each of a first pair of panels forming a collapsible container. The band includes two sections pivotally connected to one another about an intermediate pivotal axis substantially parallel to the pivotal axes between said band and the first pair of panels. The two sections are arranged with respect to one another at an included angle of about 0° when the container is in a folded-flat condition and arranged with respect to one another at an included angle of about 180° when the container is in a fully-expanded condition. A first bottom flap is connected to a first one of the plurality of collapsible container side panels. The first bottom flap engages a first surface of the band and forms an included angle of about 90° with respect to the first panel when the container is in the fully-expanded condition. A second bottom flap is connected to a second one of the plurality of panels and engages a second surface opposite the first surface of said band and forms an included angle of about 90° with respect to the second panel when the container is in the fully-expanded condition. Lastly, a web panel connects the first bottom flap with the second bottom flap. The web panel moves in response to movement of the first bottom flap. Similarly, the second bottom flap moves in response to motion in the web panel. Thereby, motion of the first flap causes motion in the second flap.

Accordingly, it is a general object of the present invention to provide an improved automatically-operating bottom structure for use with an octagonal collapsible container.

Another object of the present invention is to provide a plastic or thin paper lining in an octagonal container, the liner which automatically unfurls with the automatic operation of the bottom structure.

These and other objects and advantages of the present invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
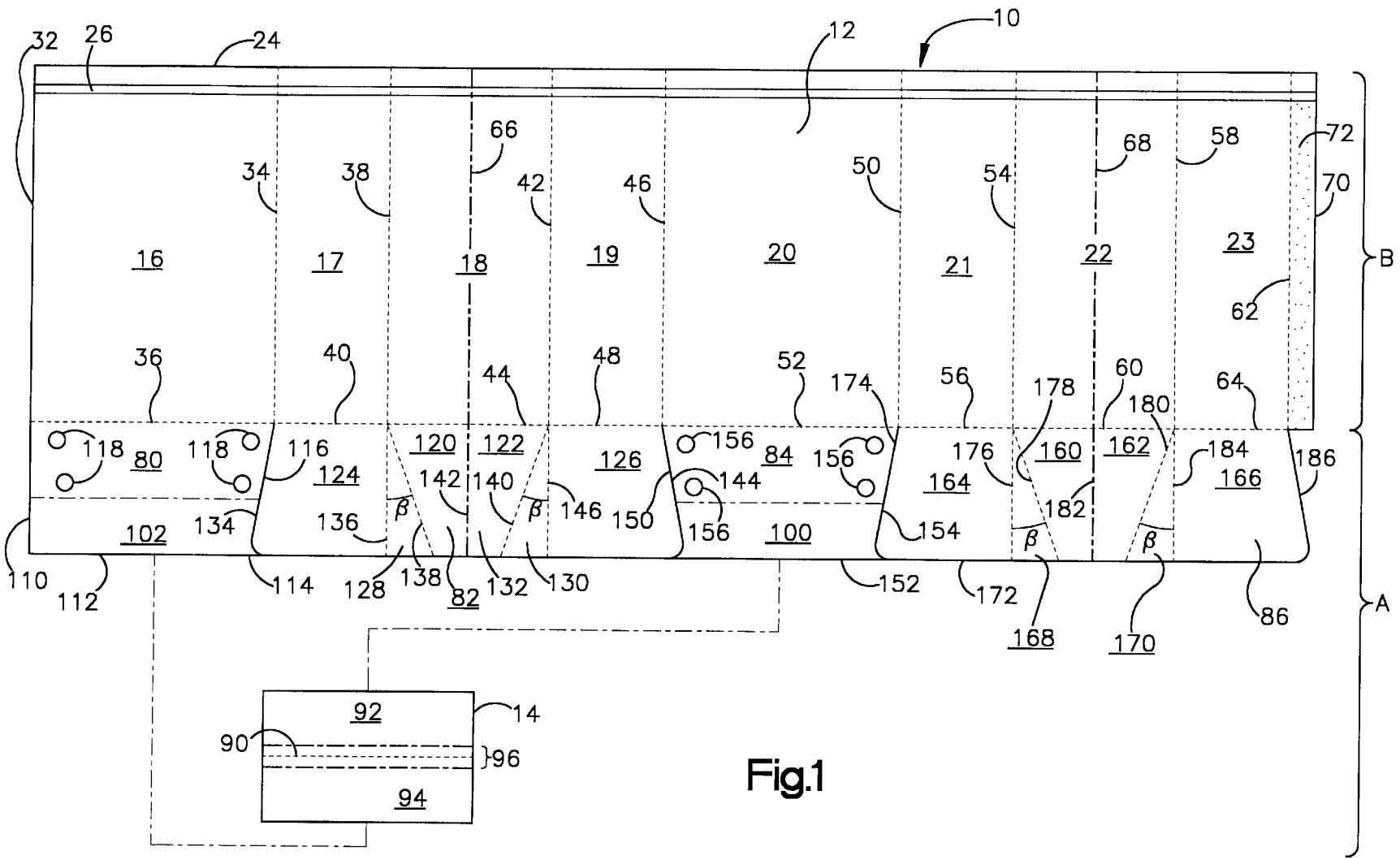
FIG. 1 is a plan view illustrating the preferred two-piece blank from which the self-opening collapsible container according to the present invention is constructed.

Referring now to the drawings wherein the showings are for purposes of illustrating the preferred embodiments of the invention only and not for purposes of limiting same, the FIGURES show an improved automatically-operating bottom structure A for use with collapsible containers. Preferably, the invention is best used with a eight-sided collapsible container B and will be described with particular reference thereto. In an alternative embodiment, the invention includes the above-mentioned automatically-operating bottom structure in combination with a plastic liner affixed to the interior panel surfaces of an octagonal container. The liner unfurls as the automatically-operating bottom structure A is operated between a folded-flat condition and a fully-expanded condition.

Figure 2:
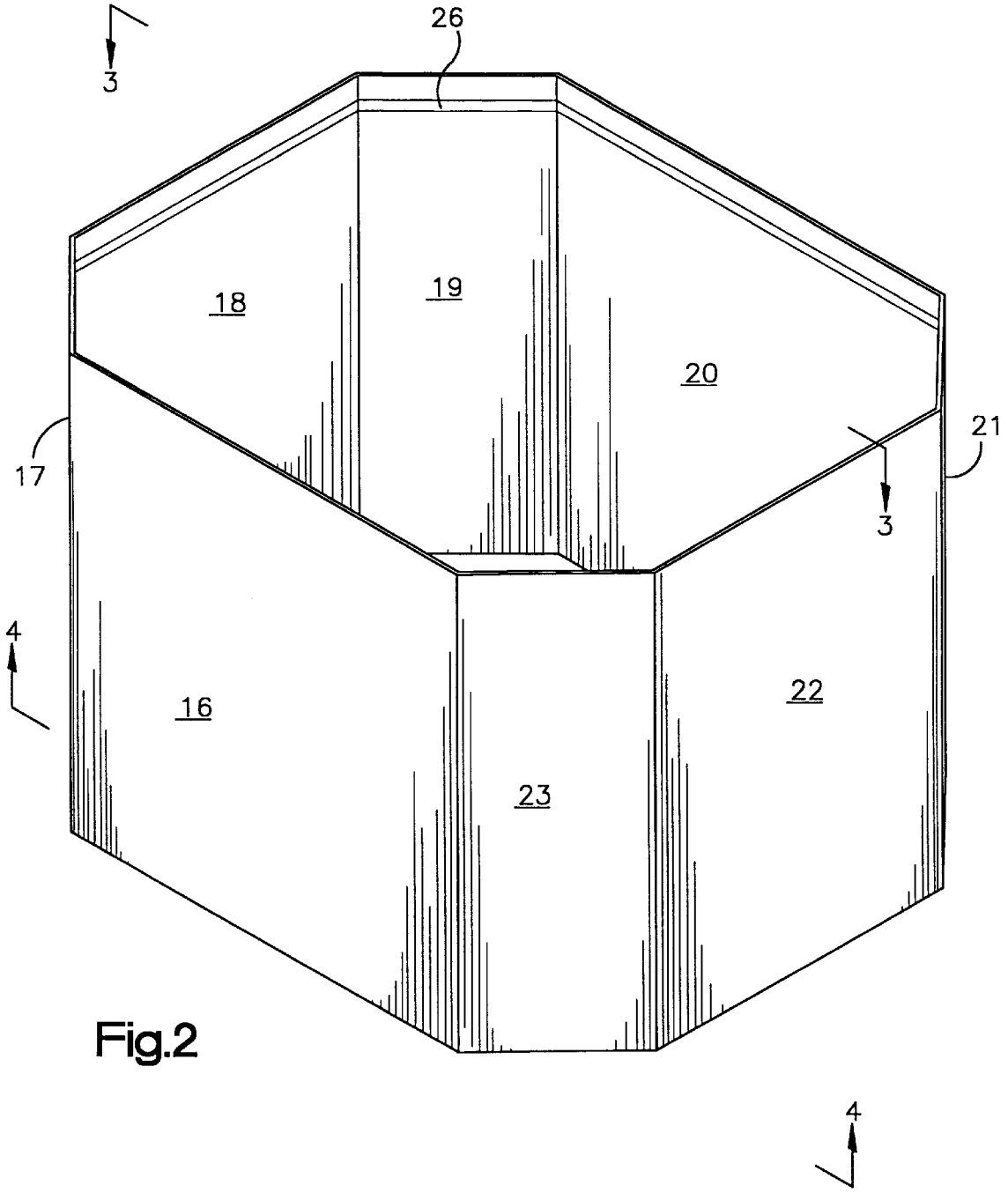
FIG. 2 is a perspective view of the preferred container employing the principals of the present invention.
Figure 3:
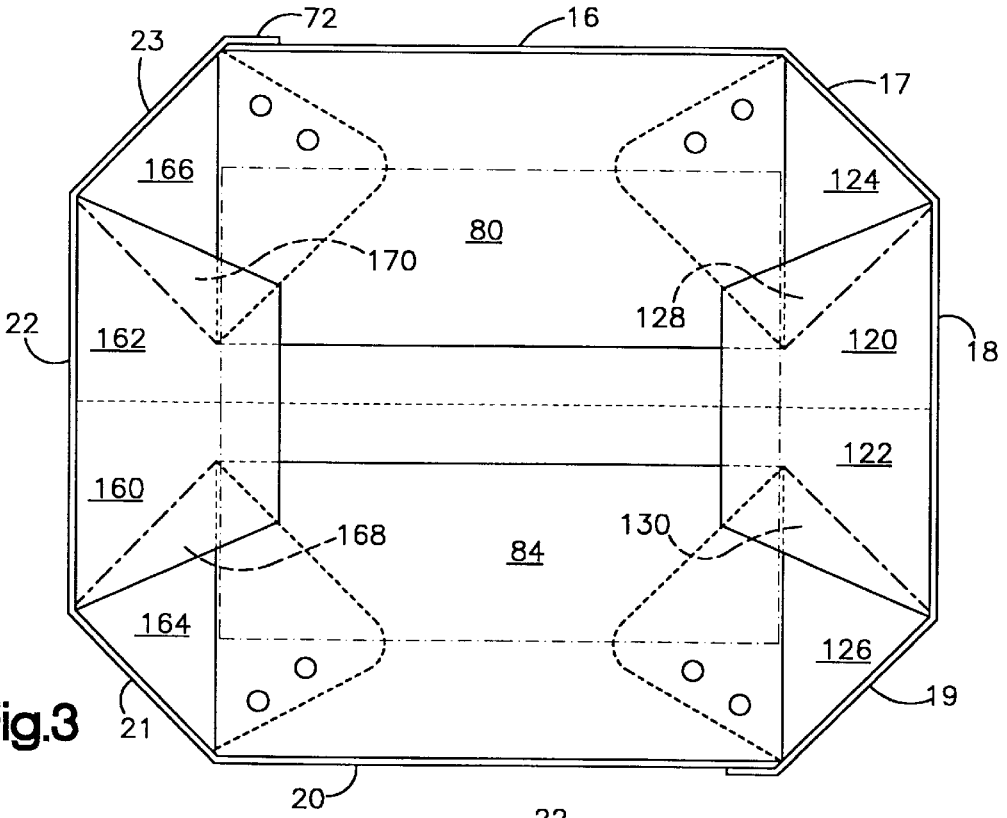
FIG. 3 is an enlarged horizontal sectional view taken along line 3—3 of FIG. 2 and looking downwardly at the bottom structure of the container of the present invention when in its fully-expanded condition.

Referring first to FIGS. 1–3, a planar blank 10 is illustrated as having a main body 12 and a connecting member 14. Both the main body 12 and the connecting member 14 are die-cut, preferably from double-faced corrugated paper although other suitable feedstock may be used such as cardboard, chipboard, single- or-double-faced corrugated paper, or the like. In addition, it is possible to construct the connecting member 14 from a material different from that forming the main body 12 such as to form a fiber board/paper combination respectively. In some applications of the preferred automatically-operating bottom structure, a plastic or hinged metallic connecting member may be used to provide additional reinforcement, rigidity and container integrity.

The main body 12 consists of eight vertically-elongated rectangular panels, individually indicated at 16–23, which are arranged side-by-side so as to be connected in series with one another. In the illustrated container, all of the rectangular panels 16–23 terminate at a common horizontal line top edge 24. A narrow glue strip 26 is disposed in series along each of the rectangular panels 16–23. The glue strip 26 runs substantially in parallel with the top edge 24.

Overall, left panel 16 is bounded by left vertical edge 32, right vertical fold line 34, and a lower horizontal fold line 36; panel 17 is bounded by left and right vertical fold lines 34, 38 and by a lower horizontal fold line 40; panel 18 is bounded by left and right vertical fold lines 38, 42 and by a lower horizontal fold line 44; panel 19 is bounded by left and right vertical fold lines 42, 46 and by a lower horizontal fold line 48; panel 20 is bounded by left and right vertical fold lines 46, 50 and by a lower horizontal fold line 52; panel 21 is bounded by left and right vertical fold lines 50, 54 and by a lower horizontal fold line 56; panel 22 is bounded by left and right vertical fold lines 54, 58 and by a lower horizontal fold line 60; and, panel 23 is bounded by left and right vertical fold lines 58, 62 and by a lower horizontal fold line 64.

An intermediate vertical score line 66 is provided in panel 18 for reasons which will be described below. Similarly, an intermediate vertical score line 68 is provided in panel 22. In general, however, each of the panels 18, 22 assume a planar configuration when the collapsible container A is in an opened condition. The score lines 66, 68 bisect panels 18, 22 respectively and enable the panels to be folded in half when the container is in folded-flat and intermediate conditions.

Each of the eight panels 16-30 are of substantially uniform height. Accordingly, left edge 32, right edge 70, and intermediate vertical score lines 34, 38, 42, 46, 50, 54, 58, 62, 66 and 68 are substantially parallel to one another, and are of substantially the same longitudinal extent. The upper edge 24 is formed in parallel with the lower fold lines 36, 40, 44, 48, 52, 56, 60 and 64 which are each represented as lying head-to-tail along a common horizontal line. The relative proportions of the various panels and fold lines depicted in the various drawing figures are, of course, dependent upon the particular thickness of the feedstock from which the blank 10 is formed. As an example, it may be necessary to offset the fold lines slightly from the adjacent edges and apart from other adjacent fold lines to permit for material flexure when using thick feedstock.

Figure 4:
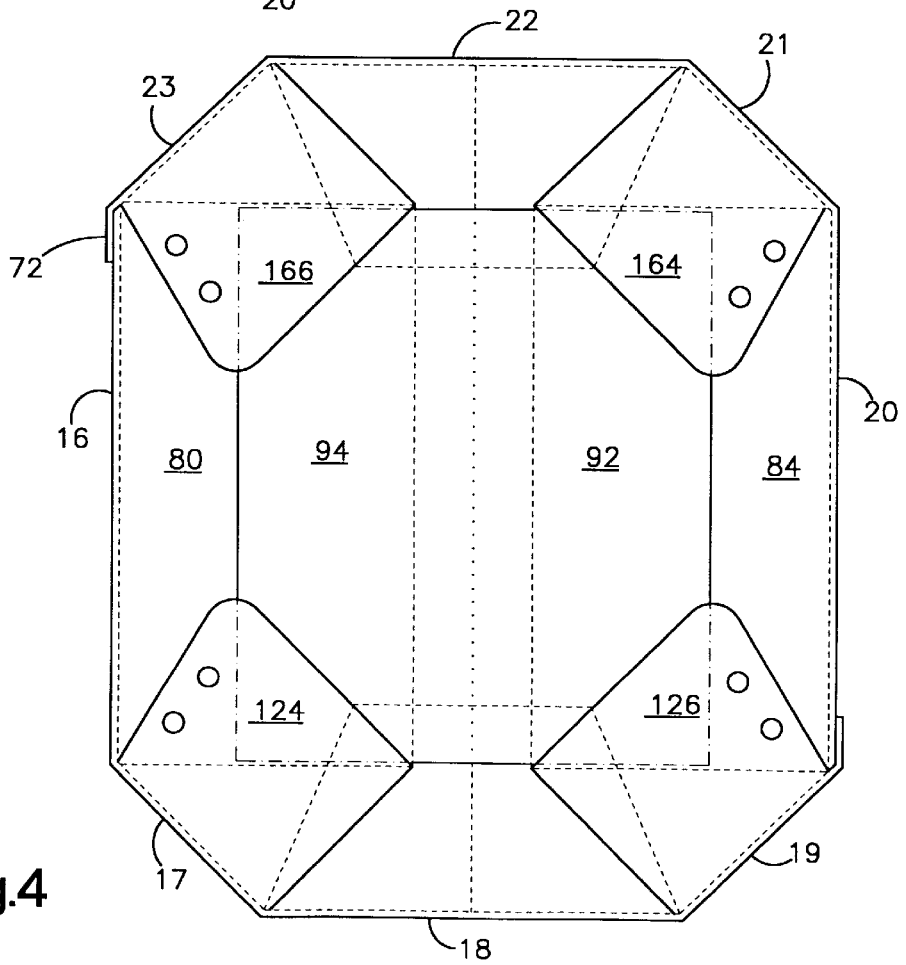
FIG. 4 is a bottom plan view of the preferred automatically-operating bottom structure in its fully-expanded condition taken generally along line 4—4 of FIG. 2; and, FIG. 5 is a top perspective view of the bottom structure according to the present invention when the container is in a midway condition between a fully collapsed position and a fully opened position shown in FIG. 2.

A vertically-elongated narrow glue tab 72 extends rightwardly from the right-most panel 23. The glue tab 72 is bounded by left fold line 62, right vertical edge 70, top edge 24, and by an extension of the lower fold line 64 of the right panel 23. A suitable adhesive is applied to the obverse surface of the glue tab 72. Hence, when the adjacent panels are bent upwardly out of the plane of the paper through angles of about 45° relative to their next-adjacent panels, the glue tab 72 will overlap the left-most marginal end portion of the outwardly-facing surface of left panel 16 when the container is assembled as shown in FIGS. 2–5. Ideally, each of the adjacent panels 16–23 should be bent or folded about the fold lines so as to be inclined with respect to its intermediately-adjacent neighboring panels by obtuse included angles of about 135°, thereby to form a regular octagon which is best illustrated in FIGS. 3 and 4.

Having thus described the preferred eight-sided collapsible container B, attention will now be directed to the automatically-operating bottom structure A according to the present invention. Broadly, the improved bottom structure A includes a first band flap 80 extending downwardly from fold line 36, a first bottom flap 82 extending downwardly from fold lines 40, 44 and 48, a second band flap 84 extending downwardly from fold line 52 and a second bottom flap 86 extending downwardly from fold lines 56, 60 and 64.

The connecting member 14 of the bottom structure A includes a fold line 90 that essentially divides the member in half. A suitable adhesive is applied to the obverse surface of the connecting member 14 on a top portion 92 and on a bottom portion 94. The adhesive coated top and bottom portions 92, 94 are spaced apart by a narrow band 96 which includes the fold line 90. When the adjacent panels 16–23 are severally bent upwardly out of the plane of the paper through angles of about 45° to make an included angle of 135° relative to their next-adjacent panels, the top portion 92 is brought into overlapping contact with a bottom edge portion 100 of the second band flap 84 and bonded thereto. Similarly, in this position, the bottom portion 94 of the connecting member 14 is bonded to a bottom edge portion 102 of the first band flap 80. The connecting member 14 assumes a planar confirmation when the collapsible container is in a fully-expanded condition and assumes a folded-over confirmation when the collapsible container is in a folded-flat condition. Although the connecting member 14 is illustrated as being substantially rectangular, any suitable shape or size connecting member may be used provided that the first and second band flaps 80, 84 are connected.

The first band flap 80 is preferably shaped substantially as shown and is joined to panel 16 via score line 36, and having a left vertical edge 110, a lower horizontal edge 112, a right pointed edge 114, and a right inclined planar edge 116. The first band flap 80 is adapted to be folded through an angle of about 90° out of the paper relative to the panel section 16 when the container is in a fully-expanded condition. In the folded-flat condition, the first band flap 80 is oriented to form an included angle of about 0° with respect to the first panel 16. That is, the first band flap 80 is folded into the plane of the paper and disposed in face-to-face registration against the panel 16 when the container is in said folded-flat condition. A plurality of spaced apart holes 118 are provided in the first band flap for permitting free air flow through the bottom structure as the container is operated.

The first bottom flap 82 is specially configured so as to define a first pair of central bottom flaps 120, 122, a first pair of outer bottom flaps 124, 126 and a pair of web panels 128, 130. In the preferred bottom structure illustrated, all of the portions of the bottom flap 82 terminate at a common horizontal line bottom edge 132.

The left-most outer bottom flap 124 is defined by a left inclined planar edge 134, the lower horizontal edge 132, a right vertical score line 136 and the bottom fold line 40 of panel 17. The left-most web panel 128 is shaped substantially as a right triangle where the included angle β is preferably about 22.5°. The left-most web panel 128 is bounded by score line 136, the lower horizontal edge 132 and by a right inclined score line 138. The first pair of central bottom flaps 120, 122 are defined by the inclined score line 138, the lower horizontal edge 132, a right included score line 140 and by the lower horizontal fold line 44 of panel 18. The first pair of central bottom flaps 120, 122 are preferably bisected by a central score line 142 which extends from the lower end of panel 18 to the lower horizontal edge of the bottom flap 82. When the container is in the fully-expanded condition, the first pair of central bottom flaps 120, 122 assume a planar configuration with respect to each other. That is, the central bottom flaps 120, 122 lie in the same plane and form an included angle of essentially 180° about score line 142. However, when the container is in the folded-flat condition, the central bottom flaps 120, 122 are in face-to-face engagement to form an included angle of about 0° by being folded over score line 142. Further, in the folded-flat condition, the central bottom flaps 120, 122 engage the panel 18 by pivoting about lower horizontal fold line 44 of panel 18 such that the fold line 142 seats into a pocket formed by the fold line 66 bisecting panel 18. In the folded flat condition, the left-most outer bottom flap 124, the left-most web panel 128, and the left-most central bottom flap 120 lie in a common single plane and engage panels 17 and 18 by forming an included angle of essentially 0° about fold lines 40 and 44.

The right-most bottom flap 126 is defined by a right inclined planar edge 144, the lower horizontal edge 132, a left vertical score line 146 and the bottom fold line 48 of panel 19. The right-most web panel 130 is substantially shaped as a right triangle where the included angle β is preferably about 22.5°. The right-most web panel 130 is bounded by the inclined score line 140, the lower horizontal edge 132, and the score line 146. In the folded flat condition, the right-most outer bottom flap 126, the right-most web panel 130 and the right-most central bottom flap 122 lie in a common single plane and engage panels 18 and 19 by forming an included angle of substantially 0° about fold lines 44 and 48. In the fully-expanded condition, the right-most web panel 130 forms an included angle of substantially 0° with respect to both the right-most central bottom flap 122 and the right-most outer bottom flap 126 but on alternate sides of the right-most web panel 130. Essentially, in the fully-expanded condition, the flaps and panels 122, 130 and 126 form a "Z" configuration.

The second band flap 84 is preferably shaped substantially as shown and is joined to panel 20 via score line 52, and having a left inclined planar edge 150, a lower horizontal edge 152, and a right inclined planar edge 154. The second band flap 84 is adapted to be folded through an angle of about 90° out of the paper relative to the panel section 20 when the container is in a fully-expanded condition. In the folded-flat condition, the second band flap 84 is oriented to form an included angle of about 0° with respect to the panel 20. That is, the second band flap 84 is folded into the plane of the paper and disposed in face-to-face registration against the panel 20 when the container is in said folded-flat condition. A plurality of spaced apart holes 156 are provided in the second band flap 84 for permitting free air flow through the bottom structure as the container is operated.

The second bottom flap 86 is especially configured so as to define a second pair of central bottom flaps 160, 162, a second pair of outer bottom flaps 164, 166, and a pair of web panels 168, 170. In the preferred bottom structure, all of the portions of the second bottom flap 86 terminate at a common horizontal bottom edge 172.

The left-most outer bottom flap 164 is defined by a left inclined planar edge 174, the lower horizontal edge 172, a right vertical score line 176 and the bottom fold line 56 of panel 21. The left-most web panel 168 is shaped substantially as a right triangle where the included angle β is preferably about 22.5°. The left-most web panel 168 is bounded by score line 176, the lower horizontal edge 172 and by a right inclined score line 178. The second pair of central bottom flaps 160, 162 are defined by the inclined score line 178, the lower horizontal edge 172, a right inclined score line 180 and by the lower horizontal fold line 60 of panel 22. The second pair of central bottom flaps 160, 162 are preferably bisected by a central score line 182 which extends from the lower end of panel 22 to the lower horizontal edge of the bottom flap 86. When the container is in the fully-expanded condition, the second pair of central bottom flaps 160, 162 assume a planar configuration with respect to each other. That is, the bottom flaps 160, 162 lie in the same plane to form an included angle of substantially 180° about score line 182. When the container is in the folded-flat condition, the bottom flaps 160, 162 are in face-to-face engagement to form an included angle of substantially 0° about score line 182. Further, in the folded-flat condition, the flaps 160, 162 engage the panel 22 by pivoting about fold line 60 such that the fold line 182 seats into a pocket formed by the fold line 68 bisecting panel 22. In the folded flat condition, the left-most outer bottom flap 164, the left-most web panel 168, and the left-most central bottom flap 160 lie in a common single plane and engage panels 21 and 22 by forming an included angle of substantially 0° about fold lines 56 and 60.

The right-most outer bottom flap 166 is defined by a left vertical score line 184, the lower horizontal edge 172, a right inclined vertical score line 186, and the bottom fold line 64 of panel 23. The right-most web panel 170 is shaped substantially as a right triangle where the included angle β is preferably about 22.5°. The right-most web panel 170 is bounded by inclined vertical score line 180, the lower horizontal edge 172, and by the right vertical score line 184. In the folded flat condition, the right-most outer bottom flap 166, the right-most web panel 170, and the right-most central bottom flap 162 lie in a common single plane and engage panels 22 and 23 by forming an included angle of substantially 0° about fold lines 60 and 64.

Figure 5:
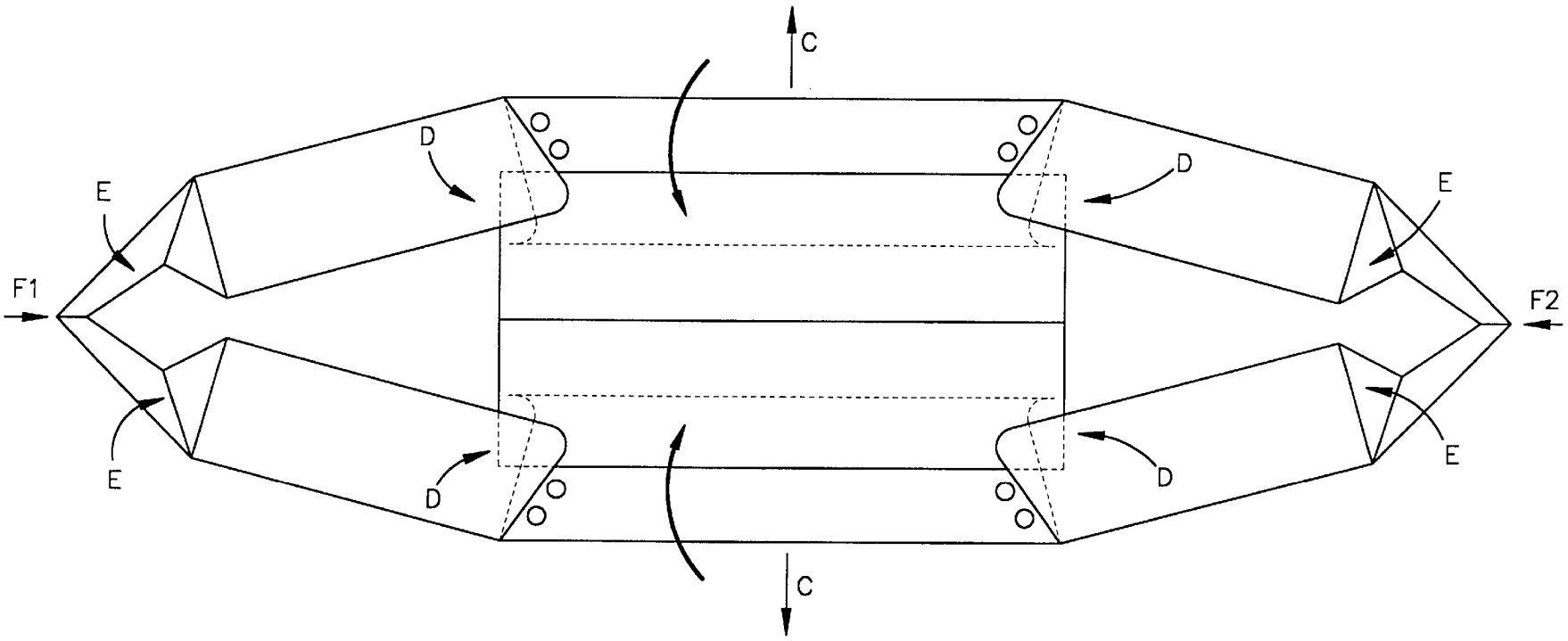

Turning now to the operation of the automatically-operating bottom structure reference will be made to FIG. 5. In an alternative embodiment of the present invention where a plastic liner is included glued along strip 62 of the container in combination with the automatically-operating bottom structure, the liner "unfurls" due to the motion of the panel portions comprising the bottom structure. In FIG. 5, the collapsible container and improved automatically-operating bottom structure are illustrated in an intermediate position between the folded-flat and fully-expanded conditions. The application of a pair of opposing forces F1, F2 at fold lines 66 and 68 respectively causes the collapsible container to expand. More particularly, the forces F1, F2 urge the panels 18 and 22 into relative motion toward one another respectively. This in turn causes the panels 16 and 20 to separate in a direction marked C. As the panels 16 and 20 separate, the first and second band flaps 80, 82 pivot from a 0° included angle to a 90° include angle with respect to their corresponding panels 16 and 20 respectively. The connecting member 14 pivots about fold line 90 as the panels 16, 20 separate and draw down into the page first and second band flaps 80 and 84 respectively.

Corresponding to the above-defined motion of the first and second band flaps 80, 84, the first and second pair of outer bottom flaps 124, 126 and 164, 166 move from a position of contact with their corresponding panel sections 17, 19 and 20, 23 respectively until an included angle of about 90° is formed therebetween. The first and second pairs of outer bottom flaps 124, 126 and 164, 166 move in a curvlinear direction with respect to the plane of the paper in a direction labeled D.

As the first and second pairs of outer bottom flaps 124, 126 and 164, 166 move, the first and second pairs of central bottom flaps 120, 122 and 160, 162 are drawn into the page as web illustrated via connection to the first and second pairs of web panels 128, 130 and 168, 170 respectively. The first and second pairs of central bottom flaps 120, 122 and 160, 162 move between contact with their corresponding panels 18 and 22 to an included angle of about 90° with respect to those panels in the fully-expanded condition. The first and second pairs of central bottom flaps 120, 122 and 160, 162 move in the direction labeled E in the drawings. As can be seen from the FIGURE, the first and second band flaps 80, 84 as well as the connecting member 14 are captured between the outer flaps 124, 126, 164, 166 and the central flaps 120, 122, 160, 162 when the collapsible container is in the fully-expanded condition.

In the fully-expanded condition, the automatically-operating bottom structure A defines a plurality of panel portion planes which are stacked one upon another in a parallel arrangement. Generally, the central bottom flaps 120, 122 and 160, 162 engage the first and second band flaps 80, 84 respectively. The band flaps 80, 84 prevent pivotal motion of the central bottom flaps 120, 122 and 160, 162 beyond 90° with respect to their corresponding panels 18 and 22 respectively. In this condition, the first and second pair of web panels 128, 130 and 168, 170 are tucked under the first and second central bottom flap pairs 120, 122 and 160, 162 respectively as best illustrated in FIGS. 3 and 4. The first and second pairs of outer bottom flaps 124, 126 and 164, 166 are disposed beneath the connecting member 14 from the perspective of the bottom of the fully-expanded container as best illustrated in FIG. 4.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

Having thus described the invention, I now claim:

1. A container adapted to be selectively moved between a folded condition and an expanded condition, comprising:

a plurality of panels being pivotally connected along adjacent longitudinal edges so as to be arranged in series with one another, the panels being arranged in generally opposing pairs when the container is in an expanded condition;

a band pivotally connected to each of a first pair of said panels, the band having at least first and second sections disposed about an intermediate pivotal axis therebetween, said intermediate pivotal axis generally parallel to pivotal axes between the band and each of the first pair of panels, the first and second sections being disposed with one another and with their respective panels so as to be generally parallel to one another when the container is in a folded condition and generally co-planar to one another when the container is in the expanded condition;

a first pair of bottom flaps, each connected respectively to one panel of a second pair of said panels, each of the first pair of bottom flaps adapted to partially overlap a first surface of the band so as to be generally perpendicular to its associated panel and generally parallel with the band when the container is in the expanded condition;

a second pair of bottom flaps, each connected respectively to one panel of a third pair of said panels, each of the second pair of bottom flaps adapted to partially overlap a selected surface of the band so as to be generally perpendicular to its associated panel and generally parallel with the band when the container is in the expanded condition;

a third pair of bottom flaps, each connected respectively to one panel of a fourth pair of said panels, each of the third pair of bottom flaps adapted to be generally perpendicular to its associated panel when the container is in the expanded condition;

at least one pair of web panels, each said web panel being pivotally connected to at least one bottom flap of a pair of said bottom flaps, wherein each of said at least one pair of web panels is generally parallel with said at least one bottom flap of a pair of said bottom flaps when the container is fully expanded, and each of said at least one pair of web panels is generally co-planar with said at least one bottom flap of a pair of said bottom flaps when the container is fully flat.

2. A collapsible container according to claim 1, wherein each of said second pair of said panels and its associated one of said first pair of bottom flaps are folded about a longitudinal axis substantially midway between the longitudinal edges of said panels, the respective halves of said second pair of panels being generally parallel when the container is in said folded-flat condition and being generally co-planar when the container is fully expanded.

3. A collapsible container according to claim 2, wherein each of said at least one pair of web panels partially overlaps said first surface of said band when the container is fully expanded.

4. A collapsible container according to claim 1, wherein said band includes a connecting member bonded to said first and second sections of said band, said connecting member defining said intermediate pivotal axis.

5. A collapsible container adapted to be selectively moved between a folded-flat condition and a fully-expanded condition, said container having a plurality of panels being pivotally connected along adjacent longitudinal edges so as to be arranged in series with one another, said panels being arranged in opposing pairs when the container is in said fully-expanded condition, and an automatically-operating bottom structure comprising:

a band pivotally connected to each of a first pair of said panels, the band having at least first and second sections, and connecting means bonded to said at least first and second sections for connecting said first and second sections about an intermediate pivotal axis substantially parallel to pivotal axes between said band and the first pair of panels, said first and second sections being disposed with respect to one another so as to be generally parallel to one another when said container is in said folded-flat condition and being disposed with respect to one another so as to be generally co-planar when said container is in said fully-expanded condition;

a first pair of bottom flaps each connected respectively to one of a second pair of said panels, each of said first pair of bottom flaps adapted to be generally perpendicular to its associated panel when the container is in said fully-expanded condition;

a second pair of bottom flaps, each connected respectively to one panel of a third pair of said panels, each of said second pair of bottom flaps adapted to be generally perpendicular to its associated panel when the container is in the fully-expanded condition; and a third pair of bottom flaps, each connected respectively to one panel of a fourth pair of said panels, each of said third pair of bottom flaps adapted to be substantially perpendicular to its associated panel when the container is the fully-expanded condition.

6. A collapsible container according to claim 5, wherein said container further comprises at least one pair of web panels, each panel of a pair thereof being pivotally connected to at least one bottom flap of a pair of said bottom flaps.

7. A collapsible container according to claim 5, wherein each of said second pair of said panels and its associated one of said first pair of bottom flaps are folded about a longitudinal axis substantially midway between the longitudinal edges of said panels, the respective halves of said second pair of panels being generally parallel when the container is in said folded-flat condition and being generally co-planar when the container is fully expanded.

8. A method of forming a container from a folded condition to an expanded condition comprising the steps of:

applying pressure to generally opposed exterior surfaces of a plurality of panels pivotally connected along adjacent longitudinal edges so as to be arranged in series with one another to form a contiguous exterior and a contiguous interior therefrom, the panels being arranged in generally opposing pairs when the container is in the expanded condition wherein orientation of each of the plurality of panels is altered relative to each panel connected thereto by transfer of force along the pivotal connection therebetween;

expanding, as a result of the step of applying pressure, first and second sections of a band bonded to a connecting member defining an intermediate pivotal axis, wherein the first second sections are pivotally disposed to one another about the intermediate pivotal band axis, and pivotally connected to each of a first pair of said panels, said intermediate pivotal band axis generally parallel to pivotal axes between the band and each of the first pair of panels, wherein during such expanding the first and second sections are urged from a position wherein their respective panels are generally parallel to one another when the container is in a folded condition to a position wherein the panels are generally co-planar to one another when the container is in the expanded condition;

expanding, as a result of the step of applying pressure, a first pair of bottom flaps, each connected respectively to one of a second pair of said panels, each of the first pair of bottom flaps adapted to partially overlap a first surface of the band so as to be generally perpendicular to its associated panel and generally parallel with the band when the container is in the expanded condition;

expanding, as a result of the step of applying pressure, a second pair of said bottom flaps, each connected respectively to one panel of a third pair of said panels, each of the second pair of bottom flaps adapted to partially overlap a selected surface of the band so as to be generally perpendicular to its associated panel and generally parallel with the band when the container is in the expanded condition;

expanding, as a result of the step of applying pressure, a third pair of said bottom flaps, each connected respectively to one panel of a fourth pair of the panels, each of the third pair of bottom flaps adapted to be generally perpendicular to its associated panel when the container is in the expanded condition;

expanding, as a result of the step of applying pressure, at least one pair of web panels, wherein each said web panel is pivotally connected to at least one bottom flap of a pair of said bottom flaps.

9. A container adapted to be selectively moved between a folded condition and an expanded condition, comprising:

a plurality of panels being pivotally connected along adjacent longitudinal edges so as to be arranged in series with another, the panels being arranged in generally opposing pairs when the container is in an expanded condition;

a band pivotally connected to each of a first pair of said panels, the band including first and second sections, and a connecting means bonded to the first and second sections for pivotally connecting the first and second sections about an intermediate pivotal axis therebetween, said intermediate pivotal axis generally parallel to pivotal axes between the band and each of the first pair of panels, the first and second sections being disposed with one another and with their respective panels so as to be generally parallel to one another when the container is in a folded condition and generally co-planar to one another when the container is in the expanded condition;

a first pair of bottom flaps, each connected respectively to one panel of a second pair of said panels, each of the first pair of bottom flaps adapted to partially overlap a first surface of the band so as to be generally perpendicular to its associated panel and generally parallel with the band when the container is in the expanded condition;

a second pair of bottom flaps, each connected respectively to one panel of a third pair of said panels, each of the second pair of bottom flaps adapted to partially overlap a selected surface of the band so as to be generally perpendicular to its associated panel and generally parallel with the band when the container is in the expanded condition;

a third pair of bottom flaps, each connected respectively to one panel of a fourth pair of said panels, each of the third pair of bottom flaps adapted to be generally perpendicular to its associated panel when the container is in the expanded condition;

at least one pair of web panels, each said web panel being pivotally connected to at least one bottom flap of a pair of said bottom flaps.

* * * * *